US005800977A

United States Patent [19]

Taylor et al.

[11] Patent Number: 5,800,977

[45] Date of Patent: Sep. 1, 1998

[54] HARDENING A HYDROPHILIC COLLOID COMPOSITION

[75] Inventors: Jeffrey Facer Taylor, Fairport; Hwei-Ling Yau, Rochester; Elmer Charles Flood, Canandaigua; Lan Bach Thai, Penfield; Susan A. Visser, Rochester, all of N.Y.

[73] Assignee: Eastman Kodak Company, Rochester, N.Y.

[21] Appl. No.: 686,082

[22] Filed: Jul. 24, 1996

[51] Int. Cl.[6] ..... G03C 1/30

[52] U.S. Cl. ..... 430/621; 430/629; 430/640; 252/182.17; 530/354

[58] Field of Search ..... 430/621, 629, 430/640; 106/154.11; 527/201; 510/339, 345, 420; 252/182.17; 530/354

[56] References Cited

U.S. PATENT DOCUMENTS

| | | | |
|---|---|---|---|
| T887,006 | 6/1971 | Burness et al. | 96/111 |
| 3,380,829 | 4/1968 | Frederick et al. | 96/66 |
| 3,490,911 | 1/1970 | Burness et al. | 96/111 |
| 3,539,644 | 11/1970 | Burness et al. | 260/607 |
| 3,642,486 | 2/1972 | Burness et al. | 96/111 |
| 3,841,872 | 10/1974 | Burness et al. | 96/67 |
| 3,850,639 | 11/1974 | Dallon et al. | 96/67 |
| 3,886,084 | 5/1975 | Vassiliades | 252/316 |
| 4,161,407 | 7/1979 | Campbell | 96/114 |
| 4,168,166 | 9/1979 | Land | 96/3 |
| 4,173,481 | 11/1979 | Sera et al. . | |
| 4,273,672 | 6/1981 | Vassiliades | 252/316 |
| 4,460,679 | 7/1984 | Schadt | 430/409 |
| 4,460,680 | 7/1984 | Ogawa et al. | 430/434 |
| 4,481,284 | 11/1984 | Ogawa et al. | 430/355 |
| 4,670,377 | 6/1987 | Miyoshi et al. | 430/621 |
| 4,847,189 | 7/1989 | Suzuki et al. | 430/567 |
| 4,897,344 | 1/1990 | Okamura et al. | 430/622 |
| 4,975,360 | 12/1990 | Sasaki et al. | 430/512 |
| 5,071,736 | 12/1991 | Ikenoue et al. | 430/533 |
| 5,147,344 | 9/1992 | Sachau et al. | 604/368 |
| 5,342,729 | 8/1994 | Aono | 430/203 |
| 5,411,856 | 5/1995 | Riecke et al. . | |

FOREIGN PATENT DOCUMENTS

| | | |
|---|---|---|
| 0 578 191 | 1/1994 | European Pat. Off. . |
| 243 572 A1 | of 0000 | Germany . |
| 93/12461 | 6/1993 | WIPO . |

*Primary Examiner*—Thorl Chea
*Attorney, Agent, or Firm*—Edith A. Rice

[57] ABSTRACT

A hydrophilic colloid is hardened with a vinyl-sulfone hardener in the presence of a borate compound in an amount sufficient to accelerate the rate of hardening. The borate compound is preferably a compound of Formula (I), or a salt, hydrate or precursor thereof:

$$B(L)_n \qquad (I)$$

wherein each L is independently —OH, —OR, —NH, —NR, or a substituted or unsubstituted alkyl group, substituted or unsubstituted aryl group, or substituted or unsubstituted heterocyclic group; R is a substituted or unsubstituted alkyl group or substituted or unsubstituted aryl group; and, n is 1, 2, or 3, with the proviso that at least one L is —OH. Preferred borate compounds are sodium and potassium borate, and hydrates thereof, and phenyl boronic acid.

25 Claims, 7 Drawing Sheets

HARDENING A HYDROPHILIC COLLOID COMPOSITION

FIELD OF THE INVENTION

This invention relates to a composition comprising a hydrophilic colloid and to a method of preparing a photographic element comprising said hydrophilic colloid composition.

BACKGROUND OF THE INVENTION

Chemical hardening of gelatin can be carried out by various means. Hardeners can be either inorganic or organic in nature. A typical inorganic hardening agent is $Ca^{++}$ or other divalent cations. Typical organic species are aldehyde, s-triazines, epoxides, isocyanates, active olefins and sulfone based hardeners to name a few [P. I. Rose, *The Theory of Photographic Process,* 4th Edition, edited by T. H. James (Macmillan Publishing Company, New York, 1977)]. Vinyl-sulfone hardeners are used to harden gelatin in the manufacture of photographic products various layers of the product. The use of vinyl-sulfones as hardeners in photographic elements is described in, for example, U.S. Pat. Nos. 3,490,911, 3,539,644, 3,642,486, 3,841,872, 4,670,377, 4,847,189, 4,847,189, 4,897,344, 4,975,360 and 5,071,736. Of particular interest are 1,2-bis(vinyl-sulfonyl)methane (BVSM), 1,2-bis(vinyl-sulfonyl)methane ether (BVSME) and 1,2-bis (vinyl-sulfonyl acetoamide)ethane (BVSAE).

The use of polymeric hardeners in a gelatin system has been reported in the literature. See D. M. Burness and J. Pouradier, 1987 (*The Theory of Photographic Process,* 4th Edition, edited by T. H. James Macmillan Publishing Company, New York, 1977, p. 84) which discloses several polymers that are active hardeners, e.g. partially acetylated cellulose, copolymers of glycidyl acrylates, amino polymers containing chlorotriazine pendant groups. Several polymeric hardeners containing vinyl-sulfonyl side groups have been disclosed for use in hardening gelatin. See, for example U.S. Pat. Nos. 4,161,407, 4,460,680 and 4,481,284.

The use of polymeric hardeners would permit selective hardening of specific layers of a multilayer photographic element since the polymeric hardener does not migrate from the layer in which it is incorporated. However, the reactivity of polymeric hardeners has been too low for commercial use in this manner. It would be advantageous to improve the rate of hardening of polymeric hardeners and thus provide layer selective hardening.

The following considerations are present when considering the use of a given hardener: (i) the rate of the crosslinking reaction that occurs in the melt must be controllable, (ii) the rate of reaction in the coated state must be sufficiently fast to minimize afterhardening, and (iii) the reaction must be efficient to yield maximum physical properties (e.g. wet strength).

When a gelatin coating is prepared, the rate of hardening is important. If the process is too fast the coating will undergo localized gelatin solidification creating coating defects, as discussed in EP 0,578,191. Additionally, the gelation rate must be maximized to limit the amount of time needed to achieve a designated physical performance. If the hardening process requires a longer time than the time required to form a solid coating, the process of after hardening is the result. Afterhardening is simply the process of chemical hardening in the post-processed or coated state. It is important to minimize afterhardening so the cost of holding a gelatin or photographic product while this residual hardening takes place is minimized. One of the methods developed to decrease the amount of afterhardening is the use of incubation at high humidity and temperature as disclosed in WO 93/12461. This process requires investment in equipment and experience to maintain the necessary level of control. It would be advantageous to increase the rate of hardening and/or reduce the extent of afterhardening, without an adverse effect on the physical properties.

During chemical processing of a photographic product after exposure, the coating must swell with an aqueous processing solution. The durability of the coating during this swollen state is dependent upon the crosslink density or level of hardening. It would be advantageous to enhance the durability of a swollen coating.

Problem to be Solved by the Invention

This invention solves the above problems and provides a process for hardening gelatin, or other hydrophilic colloid, that increases the rate of hardening and/or reduces the extent of afterhardening without an adverse effect on the physical properties. Further, the process enhances the durability of a swollen photographic layer of a photographic element.

SUMMARY OF THE INVENTION

One aspect of this invention comprises a composition comprising an aqueous medium containing a hydrophilic colloid, a vinyl-sulfone hardener and a borate compound in an amount sufficient to accelerate the rate of hardening.

Another aspect of this invention comprises a method of preparing a photographic element which comprises forming a composition comprising an aqueous medium, a hydrophilic colloid, a vinyl-sulfone hardener and a borate compound in an amount to accelerate the rate of hardening, coating the composition onto a photographic support and drying.

Yet another aspect of this invention is a photographic element prepared by this process.

In preferred embodiments of the invention, the borate compound is of Formula (I), or a hydrate, salt or precursor thereof:

$$B(L)_n \qquad \text{(I)}$$

wherein each L is independently —OH, —OR, —NH, —NR, or a substituted or unsubstituted alkyl group, substituted or unsubstituted aryl group, or substituted or unsubstituted heterocyclic group; R is a substituted or unsubstituted alkyl group or substituted or unsubstituted aryl group; and, n is an integer of 1–4, with the proviso that at least one L is —OH.

In preferred embodiments of the invention, the vinyl-sulfone hardener is a non-polymeric compound. In other preferred embodiments of the invention, a polymeric vinyl-sulfone hardener is used in addition to the non-polymeric vinyl-sulfone hardener.

Advantageous Effect of the Invention

The photographic element of this invention exhibits (i) an increase in the wet strength as illustrated by an increase in the value obtained from a mushiness test (also known as MAST), and (ii) a decrease in the time required for afterhardening.

A primary advantage of using a borate compound combined with a vinyl-sulfone hardener is an increase in hardener activity. Another advantage is the ability to control the rate of crosslinking of the hydrophilic colloid. A further advantage is the reduction in afterhardening. The invention also provides a photographic element with improved durability.

DETAILED DESCRIPTION OF THE INVENTION

Figure 1:
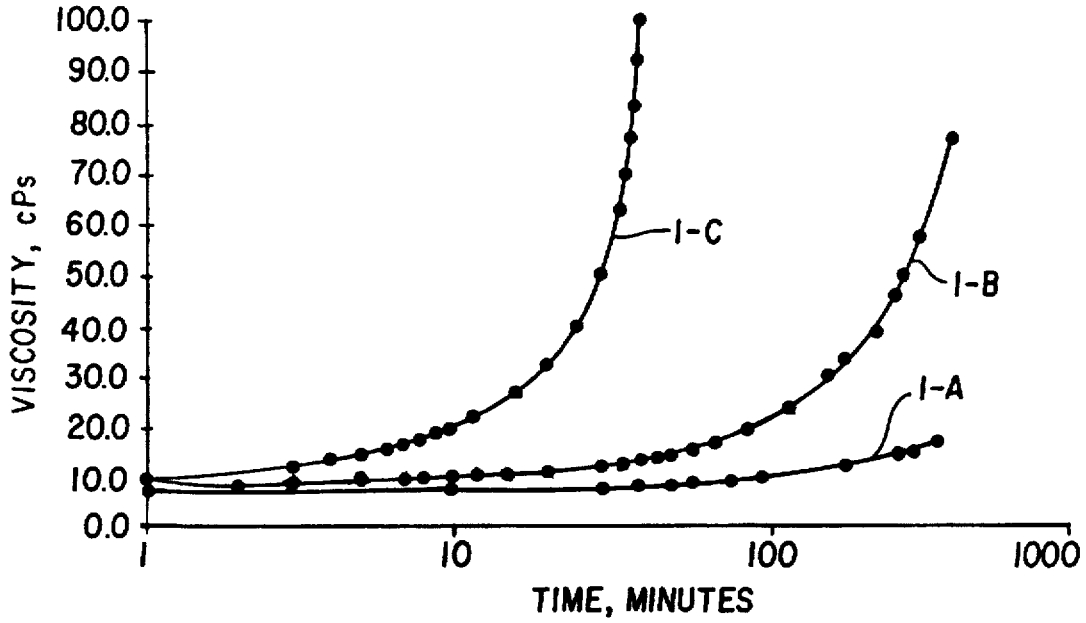
FIG. 1 is a graph showing the increase in rate of hardening a gelatin melt using a combination of a vinyl-sulfone hardener (BVSM) and a borate compound.

Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like.

Vinyl-sulfone hardeners are well known. Typical vinyl-sulfone hardeners are described in U.S. Pat. Nos. 3,490,911, 3,539,644, 3,642,486, 3,841,872, 4,670,377, 4,897,344, 4,975,360 and 5,071,736, the entire disclosures of which are incorporated herein by reference.

Preferred vinyl-sulfone hardeners for use in the present invention are represented by Formula (II) indicated below:

$$X^1—SO_2—L^1—SO_2—X^2 \qquad \text{(II)}$$

wherein $X^1$ and $X^2$ represent $—CH=CH_2$ or $—CH_2CH_2—Y$ groups, and $X^1$ and $X^2$ may be the same or different; Y represents a group which can be substituted by a nucleophilic reagent having a nucleophilic group, or a group which can be eliminated in the form of HY by means of a base; and $L^1$ is a divalent linking group which may be substituted.

The film hardening agent of the present invention represented by Formula (II) is described in detail below. Therein, $X^1$ and $X^2$ represent $—CH=CH_2$ or $—CH_2CH_2—Y$ groups, wherein Y is a group which is substituted or eliminated by the action of a nucleophilic reagent or a base such as those having an amino group or a hydroxy group, and preferred examples of the groups $X^1$ and $X^2$ are indicated below.

$—CH=CH_2$, $—CH_2CH_2—Cl$ $—CH_2CH_2—Br$, $—CH_2CH_2—OSO_2CH_3$ $—CH_2CH_2—OSO_2C_6H_5$, $—CH_2CH_2—OSO_2C_6H_4—CH_3$ $—CH_2CH_2—OSO_3Na$, $—CH_2CH_2—OSO_3K$ $—CH_2CH_2—OCOCH_3$, $—CH_2CH_2—OCOCF_3$ $—CH_2CH_2—OCOCHCl_2$

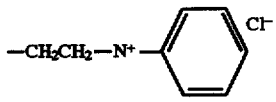

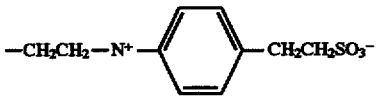

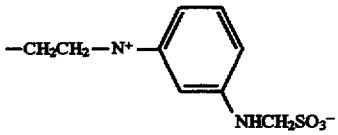

Particularly preferred examples of the groups $X^1$ and $X^2$ are indicated below.

$—CH=CH_2$, $—CH_2CH_2—Cl$ $—CH_2CH_2—Br$, $—CH_2CH_2—OSO_2CH_3$ $—CH_2CH_2—OSO_2CH_3$, $—CH_2CH_2—OSO_3Na$ $—CH_2CH_2—OSO_3K$

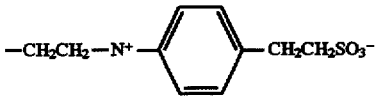

-continued

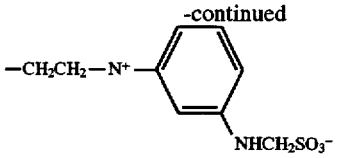

Moreover, the —CH=$CH_2$ group is the most desirable.

The divalent linking group $L^1$ is a divalent group having up to 30 carbon atoms, preferably up to 10 carbon atoms, and comprising an alkylene group (including cycloalkylene groups), an arylene group (including heterocyclic aromatic groups such as 5- to 7-membered ring groups containing 1 to 3 hetero atoms (e.g., a divalent group derived from thiadiazole or pyridine) or combinations of these groups with one or more units represented by —O—, —$NR^1$—, —$SO_2$—, —$SO_3$—, —S—, —SO, —$SO_2NR^1$—, —CO—, —COO—, —$CONR^1$—, —$NR^1COO$— and $NR^1CONR^1$—. Here, $R^1$ represents hydrogen or an alkyl group having from 1 to 15 carbon atoms, an aryl group or an aralkyl group. The $R^1$ groups may be joined together to form ring structures when the linking group includes two or more units of —$NR^1$, —$SO_2NR^1$—, —$CONR^1$—, —$NR^1COO$— and —$NR^1CONR^1$—. Moreover, $L^1$ may also be substituted by, for example, hydroxyl groups, alkoxy groups, carbamoyl groups, sulfamoyl group, sulfo groups or salts thereof, carboxyl groups or salts thereof, halogen atoms, alkyl groups, aralkyl groups and aryl groups. Furthermore, the substituent groups may be further substituted with one or more groups represented by $X^3$—$SO_2$—. Here, $X^3$ has the same significance as $X^1$ and $X^2$ described above.

The groups indicated below are typical examples of the linking group $L^1$. In these examples, a–k are integers of from 1 to 6. Of these, e can also have a value of zero, but e is preferably 2 or 3. The values of a–k except e are preferably 1 or 2, and most desirably are 1. In these formula, $R^1$ preferably represents a hydrogen atom, or an alkyl group having from 1 to 6 carbon atoms, and most desirably represents a hydrogen atom, a methyl group or an ethyl group. $L^1$ is preferably:

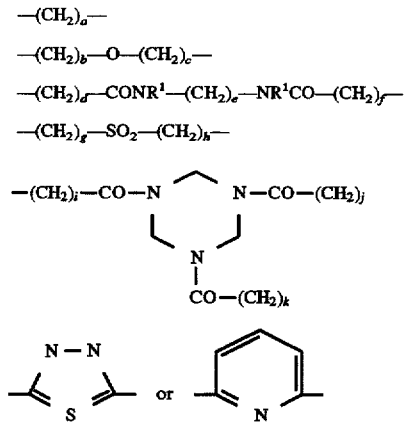

Typical nonlimiting examples of the film hardening agents for use in the present invention are indicated below.

H-1: $CH_2$=$CHSO_2CH_2SO_2CH$=$CH_2$

H-2: $CH_2$=$CHSO_2CH_2OCH_2SO_2CH$=$CH_2$

H-3: $CH_2$=$CHSO_2CH_2CH_2CH_2SO_2CH$=$CH_2$

H-4: $CH_2$=$CHSO_2CH_2CH(OH)CH_2SO_2CH$=$CH_2$

H-5: $CH_2$=$CHSO_2CH_2CONHCH_2CH_2NHCOCH_2SO_2CH$=$CH_2$

H-6: $CH_2$=$CHSO_2CH_2CONHCH_2CH_2CH_2NHCOCH_2SO_2CH$=$CH_2$
$_{pc20}$

H-7:

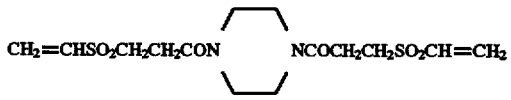

H-8:

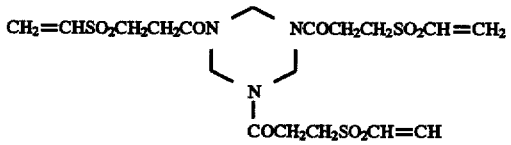

H-9:

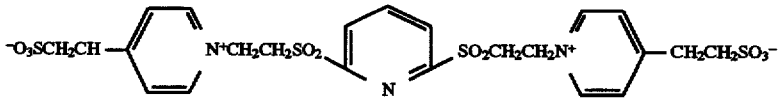

H-10:

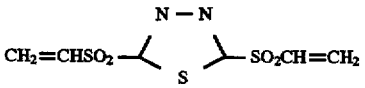

H-11: $(CH_2$=$CHSO_2CH_2)_3CCH_2SO_2CH_2CH_2NHCH_2CH_2SO_3Na$

H-12: $(CH_2$=$CHSO_2)_2CHCH_2CH_2$—$C_6H_4$—$SO_3Na$

The vinyl-sulfone hardener is preferably a non-polymeric bis(vinyl-sulfone) such as bis(vinyl-sulfonyl) methane (BVSM) bis(vinyl-sulfonyl methyl) ether BVSME or 1,2-bis(vinyl-sulfonyl acetoamide)ethane (BVSAE), etc.

The non-polymeric vinyl-sulfone hardener preferably has a molecular weight of less than 10,000. More preferably the non-polymeric vinyl-sulfone hardener has a molecular weight of about 100 to about 5,000.

In other embodiments of the invention the vinyl-sulfone hardener is polymeric, such as the polymeric hardeners disclosed in U.S. Pat. Nos. 4,161,407, 4,460,680 and 4,481,284, the entire disclosures of which are incorporated herein by reference.

Preferred polymeric vinyl-sulfone hardeners are represented by Formula (III):

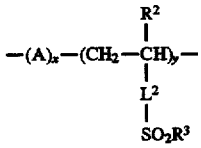

(III)

wherein A is a monomer unit prepared by copolymerizing copolymerizable ethylenically unsaturated monomers, $R^2$ is hydrogen or a lower alkyl group having 1 to 6 carbon atoms; $L^2$ is a bivalent linking group, and $R^3$ is $—CH{=}CH_2$ or $—CHCH_2CH_2X^3$, where $X^3$ is a group capable of being substituted with a nucleophilic group or a group capable of being released in the form of HX upon addition of a base, and x and y each represents molar percent, x being between 0 and 99 and y being between 1 and 100.

Examples of ethylenically unsaturated monomer represented by A of Formula (III) include examples of ethylenically unsaturated monomers represented by "A" of Formula (III) include ethylene, propylene, 1-butene, isobutene, styrene, chloromethylstyrene, hydroxymethylstyrene, sodium vinylbenzenesulfonate, sodium vinylbenzylsulfonate, N, N, N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids (e.g., vinyl acetate and allyl acetate), ethylenically unsaturated mono- or dicarboxylic acids and salts thereof (e.g., acrylic acid, methacrylic acid, itaconic acid, maleic acid, sodium acrylate, potassium acrylate and sodium methacrylate), maleic anhydride, esters of ethylenically unsaturated monocarboxylic or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N diethyl-N-methyl-N-methacryloyloxy-ethyl ammonium-p-toluene sulfonate, dimethyl itaconate and monobenzyl maleate), and amides of ethylenically unsaturated monocarboxylic or dicarboxylic acids (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, methacrylamide, N,N-dimethyl-N'-acryloyl propane diamine propionate betaine, and N,N-dimethyl-N'-methacryloyl propane diamine acetate betaine). "A" further includes monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate and neopentyl glycol dimethacrylate).

Examples or $R^2$ of Formula (III) include methyl, ethyl, butyl, tert. butyl, isopropyl, n-hexyl and the like.

Examples of $R^3$ of Formula (III) include the following groups:

$—CH{=}CH_2—$, $—CH_2CH_2Cl—$, $—CH_2CH_2Br—$, $—CH_2CH_2O_3SCH_3—$, $—CH_2CH_2OH—$, $—CH_2CH_2O_2CCH_3—$, $—CH_2CH_2O_2CCF_3—$,

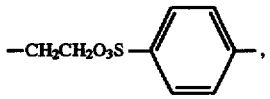

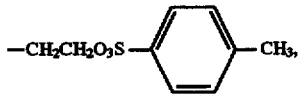

and $CH_2CH_2O_2CCHCl_2$.

$L^2$ is a bivalent linking group. In one preferred embodiment, $L^2$ is an alkylene group, preferably containing about 1 to 6 carbon atoms, an arylene group, preferably containing about 6 to 12 carbon atoms, —COZ—, or $—COZR^4—$ where $R^4$ is an alkylene group, preferably containing about 1 to 6 carbon atoms, or an arylene group, preferably containing about 6 to 12 carbon atoms. Preferably $L^2$ is a phenylene group.

In another preferred embodiment of the invention $L^2$ is preferably a linking group of the formula:

$—Q—L^3—$ wherein Q is $—CO_2—$.

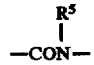

wherein $R^5$ hydrogen, a lower alkyl group having 1–6 carbon atoms or an arylene group having 6 to 10 carbon atoms; $L^3$ is a divalent group having 3 to 15 carbon atoms and containing at least one linking group selected from the members consisting of $—CO_2—$ and

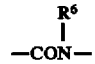

wherein $R^6$ is the same as $R^5$ above or a divalent group having 1 to 12 carbon atoms and containing at least one linking group selected from the members consisting of

—O—, $$\overset{R^7}{\overset{|}{N}}-\quad -CO-,\quad -SO-,\quad -SO_2-,\quad -SO3-,$$

$$-\overset{R^7}{\overset{|}{S}}O_2N-,\quad -\overset{R^7}{\overset{|}{N}}CO\overset{R^7}{\overset{|}{N}}-,\quad \text{or}\quad -\overset{R^7}{\overset{|}{N}}CO_2-$$

wherein $R^7$ is hydrogen or a lower alkyl group having 1–6 carbon atoms.

Examples of include the following groups:

$$-CO_2-,$$

$$-CONH-$$

$$-\overset{CH_3}{\overset{|}{C}}ON-,\quad -\overset{C_2H_5}{\overset{|}{C}}ON-,\quad -\overset{nC_4H_9}{\overset{|}{C}}ON-,$$

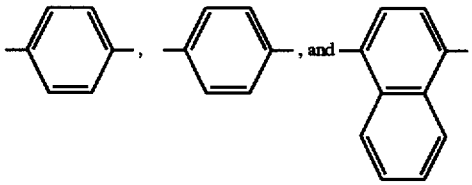

Examples of $L^3$ include the following groups:

$$-CH_2CO_2CH_2-,$$

$$CH_2CO_2CH_2CH_2-,$$

$$CH_2CH_2CO_2CH_2CH_2-,$$

$$-(CH_2)_{10}CO_2CH_2CH_2-,$$

$$-(CH_2)_5CO_2CH_2CH_2-,$$

$$-CH_2NHCOCH_2-,$$

$$-CH_2NHCOCH_2CH_2-,$$

$$-(CH_2)_3NHCOCH_2CH_2-,$$

$$-(CH_2)_5NHCOCH_2CH_2-,$$

$$-(CH_2)_{10}NHCOCH_2CH_2-,$$

$$CH_2OCH_2-,$$

$$-CH_2CH_2OCH_2CH_2CH_2-,$$

$$-\overset{CH_3}{\overset{|}{N}}CH_2CH_2-,\quad -CH_2\overset{CH_3}{\overset{|}{N}}CH_2CH_2-,\quad -COCH_2CH_2-,$$

$$-CH_2COCH_2CH_2-,\quad -CO-$$

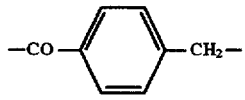

$$-CH_2-$$

$$-SOCH_2CH_2-,$$

$$-CH_2SOCH_2CH_2-,$$

$$-SO_2CH_2CH_2-,$$

$$-SO_2CH_2CH_2SO_2CH_2CH_2-,$$

$$-SO_2CH_2CH_2SO_2CH_2\underset{\underset{OH}{|}}{C}HCH_2-$$

$$-SO_3CH_2CH_2CH_2-,$$

$$-SO_3CH_2CO_2CH_2CH_2-,$$

$$-SO_3CH_2CH_2CO_2CH_2CH_2-,$$

$$-SO_2NHCH_2CO_2CH_2CH_2-,$$

$$-SO_2NHCH_2CH_2CO_2CH_2CH_2-,$$

$$-NHCONHCH_2CH_2-,$$

$$-CH_2NHCONHCH_2CH_2-,$$

$$-NHCO_2CH_2CH_2-,$$

$$-CH_2NHCO_2CH_2CH_2-,$$

Preferably the polymer comprises repeating units of the formula:

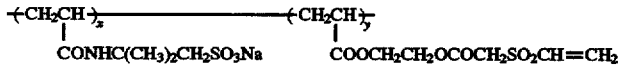

P.1 x/y = 2/1

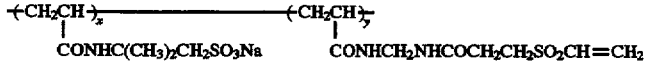

P.2 x/y = 2/1

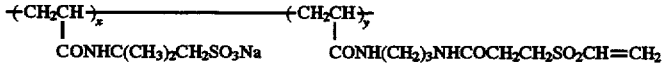

P.3 x/y = 2/1

-continued
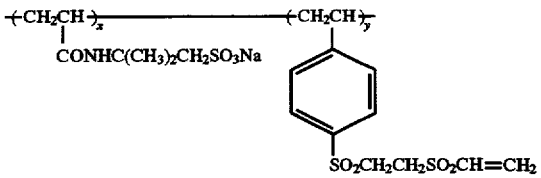
P.4
x/y = 2/1
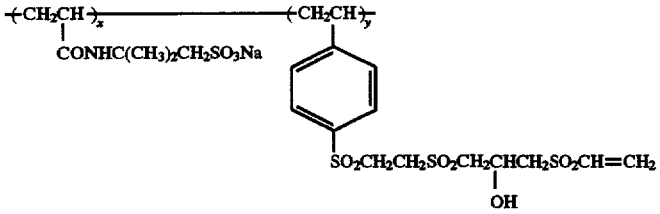
P.5
x/y = 2/1
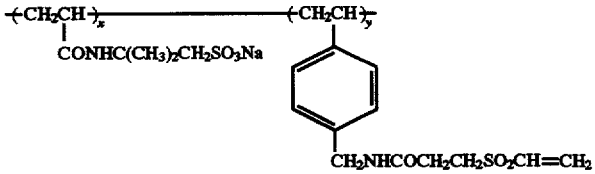
P.6
x/y = 2/1
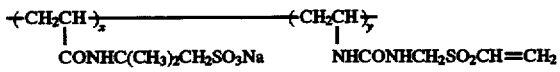
P.7
x/y = 2/1
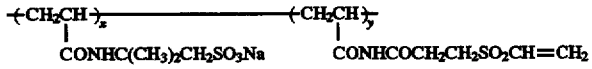
P.8
x/y = 2/1
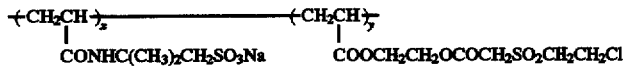
P.9
x/y = 2/1
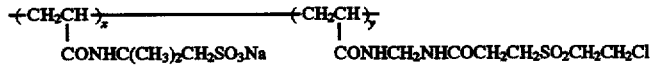
P.10
x/y = 2/1
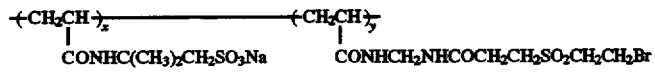
P.11
x/y = 2/1
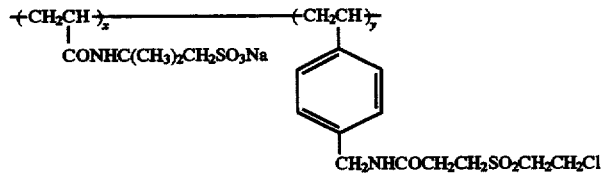
P.12
x/y = 2/1

-continued
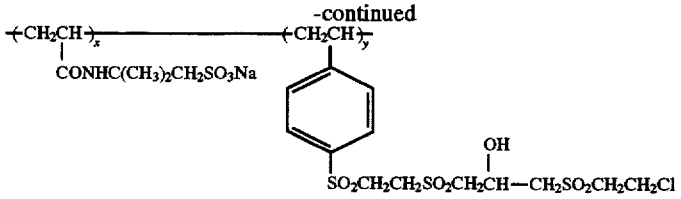
P.13
x/y = 2/1
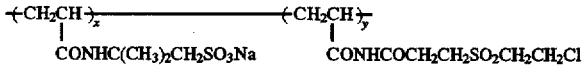
P.14
x/y = 2/1
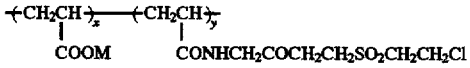
P.15
x/y = 2/1
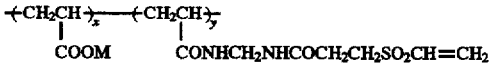
P.16
x/y = 2/1
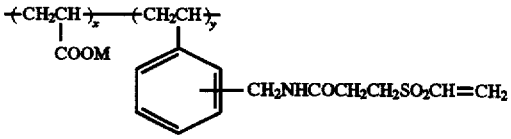
P.17
x/y = 2/1
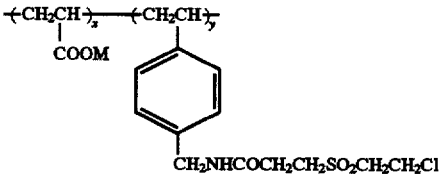
P.18
x/y = 2/1
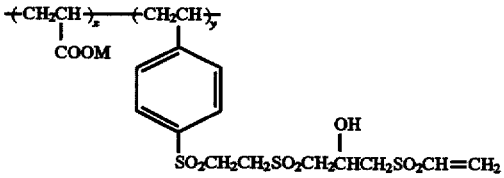
P.19
x/y = 2/1
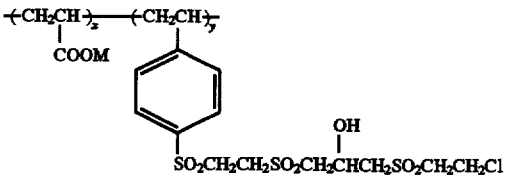
P.20
x/y = 2/1
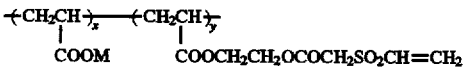
P.21
x/y = 2/1
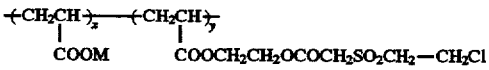
P.22
x/y = 2/1

Particularly preferred are polymers of the formula:

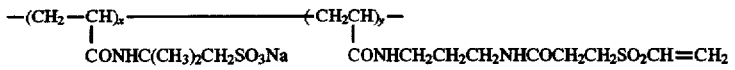

where x/y=4/1.

In the above formulae, M represents a hydrogen atom, a sodium atom or a potassium atom, and x and y represent the molar percent of the corresponding units charged. The molar percent is not limited to those specified in the above formulae, x may be from 0 to 99, and y may be from 1 to 100.

The molecular weight of the polymer is greater than 10,000. Preferably the molecular weight is in the range of 100,000 to 1,000,000, more preferably 30,000 to 500,000.

The amount of vinyl-sulfone hardener is about 0.01 to about 50 wt %, based on the weight of the hydrophilic colloid preferably about 0.5 to about 10 wt % and most preferably about 10 to about 20 wt %, based on the weight of the hydrophilic colloid In a preferred embodiment of the invention a polymeric and a non-polymeric vinyl-sulfone hardener is used to harden a hydrophilic colloid. The amount of polymeric vinyl-sulfone hardener is used in an amount of about 1 to about 3 wt %, preferably about 2 to about 3 wt %, based on the weight of the non-polymeric vinyl-sulfone hardener.

As mentioned above, in accordance with this invention, a borate compound is present in an amount sufficient to accelerate the rate of hardening. The term "borate compound" as used herein includes boric acids and ionizable compounds that provide borate ions, for example, $BO_3^-$, $BO_2^-$, $B_4O_7^{-2}$, $B_5O_8^-$, in aqueous medium. The term "boric acid" as used herein includes any of the boron oxide acids, such as, for example boric acid, hypoboric acid, boronic acid, meta-boric acid, perboric acid, pyroboric acid and the like, and salts and hydrates thereof. The borate compound contains at least one OH group which in aqueous medium provides at least one $O^-$ radical.

Particularly preferred are borate compounds of Formula (I) or a hydrate, salt or precursor thereof:

$$B(L)_n \quad \text{(I)}$$

wherein each L is independently —OH, —OR, —NH, —NR, or a substituted or unsubstituted alkyl group, substituted or unsubstituted aryl group, or substituted or unsubstituted heterocyclic group; R is a substituted or unsubstituted alkyl group or substituted or unsubstituted aryl group; and, n is 1, 2, or 3, with the proviso that at least one L is —OH.

Examples of "L" groups include substituted or unsubstituted phenyl, benzyl, methyl, ethyl, etc. Substituents that can be present include halogen, hydroxyl, alkoxy, alkyl, aryl, ester or amide groups, which may themselves be further substituted. Preferred borate compounds are inorganic salts, such as the sodium, potassium, calcium, nickel, copper, iron, aluminum and ammonium salts of a boric acid, and organic salts, such as alkyl or aryl salts of boric acids. Preferred borate compounds are sodium and potassium borates, and hydrates thereof, and phenyl boronic acid. The amount of borate added is about 14 mmole to 120 mmoles/100 g hydrophilic colloid, preferably about 20 mmoles to 100 mmole/100 g hydrophilic colloid.

In the method of this invention, the vinyl-sulfone hardener and borate compound are added to an aqueous medium containing the hydrophilic colloid. The hardening reaction generally proceeds without heat, but to speed the reaction heat may be applied, if desired. Generally the reaction is conducted between about 15° C. to about 40° C. In certain instances, it may be desirable to enhance the hardening reaction by adjusting the pH of the aqueous medium containing the hydrophilic colloid, vinyl-sulfone hardener and borate compound.

Another aspect of this invention is the preparation of a photographic element comprises a support bearing at least one hydrophilic colloid layer hardened as described above. The photographic element further contains at least one light sensitive layer, preferably containing silver halide emulsion. The hydrophilic colloid hardened in accordance with this invention can be a surface protective layer, an intermediate layer and/or a silver halide emulsion layer, or the like.

The photographic elements made by the method of the present invention can be black and white single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red- sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green- sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative working, such as surface sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain other filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil in water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like. For example, the silver halide used in the photographic elements of the present invention may contain at least 90% silver chloride or more (for example, at least 95%, 98%, 99% or 100% silver chloride). In the case of such high chloride silver halide emulsions, some silver bromide may be present but typically substantially no silver iodide. Substantially no silver iodide means the iodide concentration would be no more than 1%, and preferably less than 0.5 or 0.1%. In particular, in such a case the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The type of silver halide grains preferably include polymorphic, cubic, and octahedral. The grain size of the silver halide may have any distribution known to be useful in photographic compositions, and may be either polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

Experimental Techniques

In the examples set forth below, the following experimental techniques were used.

Viscometry

To monitor the influence of borate compounds on a gelatin melt during the hardening process, a Brookfield Viscometer (DV-II) equipped with a sample chamber consisting of two concentric cylinders (SC4-18-spindle and an R3 chamber) was used. The viscosity was monitored at constant temperature (40° C.) and shear rate (39.6 sec.$^{-1}$). With this apparatus, the viscosity of a gelatin melt as a function of time following the addition of a hardener could be measured.

Sample solutions were prepared by combining gelatin (lime processed "LPO" or acid processed "APO" gelatin) and water to an aim of 5 wt. % gelatin in the final solution. The borate compound was added to the sample solution from a previously prepared 5 wt. % aqueous solution. The amount of the sodium borate solution added to the melt depended upon the borate concentration range desired. Typical amounts of borate compound used varied from 0–0.1 wt. % borate in the final sample melt (or 0–5 wt. % borate with respect to gelatin).

Just prior to measurement, the hardener was added to the sample and placed in the viscometer chamber. The hardener was added from an aqueous solution (1.8 wt % aqueous solution for BVSM, 2 wt. % solution for BVSME, and 1 wt. % solution for BVSAE) to produce a final sample melt concentration of 0.12 wt. % (or 2 wt. % with respect to gel). Viscosity measurements were taken periodically at intervals depending upon the rate of viscosity increase. With this experimental arrangement, several variables were examined (sodium borate concentration; BVSM vs. BVSME; sodium vs. potassium borate; and pH of the borate solution).

Nuclear Magnetic Resonance (NMR)

A correlation between the increase in viscosity and crosslink density were established using nuclear magnetic resonance (NMR). Samples were prepared with a combination of gelatin, sodium borate decahydrate, and $^{13}C$ labeled BVSM. The gelatin, sodium borate, $^{13}C$ labeled BVSM were combined and NMR spectra were collected as a function of time. The temperature was maintained at 40° C. throughout all NMR investigations.

A control sample was prepared with gelatin and $^{13}C$ labeled BVSM. When solutions required a pH adjustment, deuterated sodium hydroxide (NaOD) was used.

A reference spectrum (at time=0) was subtracted from the subsequent spectra as a function of time. This was done to remove the gelatin background. The reaction between amine and the vinyl group (i.e., crosslink density) of the $^{13}C$ labeled BVSM was monitored by integrating the area of the peaks at 42 and 45 PPM. The integrated area was scaled to the amount of BVSM (in millimoles) in each sample.

Mushiness or Multi Arm Scratch Test (MAST)

A mushiness test (also referred to as a Multi Arm Scratch Test-MAST) was used to measure the scratch resistance of the swollen sample. The test is carried out by submerging a sample coating or photographic film in a swelling agent. The swelling agent in this study was a photographic developer solution. The temperature was held constant at 39° C. A spherical-jewel stylus is dragged across the swollen sample while the normal load linearly increases with the distance dragged. At some distance along the sample, a scratch will form. The mushiness value is taken at the point that a continual scratch is formed as observed by the naked eye. This value is reported in "grams to plow".

The following examples illustrate the invention and the advantages achieved when a borate compound is used together with one or more vinyl-sulfone hardener.

Example 1

This example illustrates the improvement obtained using a combination of a vinyl-sulfone hardener and a borate compound.

Lime processed gelatin, 10.9 g, was added to a reaction vessel. The gelatin was melted by heating to a temperature of 35°–40° C. A 5% solution of sodium borate, 0.75 g, was added to provide a solution containing 2 wt % borate, based on the weight of the gelatin. Doubly distilled water, 12 g, was added. A 1.8 % solution of BVSM, 1.39 g, was added to provide 2 wt % BVSM, based on the weight of the gelatin. The resulting solution contained 5 wt % gelatin. The viscosity was measured as set forth below. This procedure was repeated with the exception that 0.5 g of the 5% solution of sodium borate was added to provide 2 wt % borate, based on the weight of the gelatin. A summary of these samples is given in Table 1.

TABLE 1

| Sample Identification | Borate Addition |
|---|---|
| 1-A | Control |
| 1-B | 2 wt. % sodium borate* |
| 1-C | 3 wt. % sodium borate* |

*Borate = sodium borate decahydrate, amounts given with respect to gelatin

The rate of hardening was examined using a Brookfield viscometer as described elsewhere. The results are illustrated in FIG. 1. It can be observed that the use of borate/BVSM hardener enhances the rate that the viscosity increases relative to BVSM alone.

Example 2

This example illustrates the correlation between the increase in viscosity and an increase in chemical crosslinking, NMR was used.

Solutions identical to those used in Example 1 were prepared, except that $^{13}C$ labeled BVSM were used. A summary of these samples is given in Table 2.

TABLE 2

| Sample Identification | Borate Addition |
|---|---|
| 2-A | Control-None |
| 2-B | 2 wt. % borate* |
| 2-C | 3 wt. % borate* |

*Borate = sodium borate decahydrate, amounts given with respect to gelatin

Figure 2:
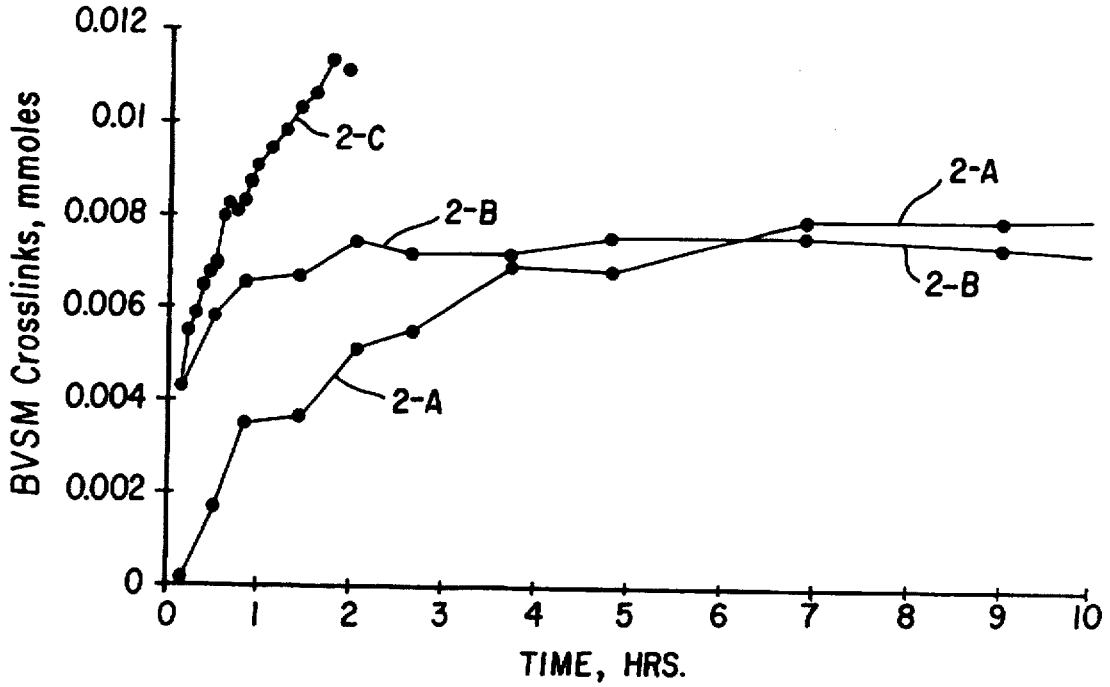
FIG. 2 is a graph showing the influence of borate on the degree of chemical crosslinking of a gelatin melt during chemical hardening.

Using NMR, the increase in crosslinked BVSM was monitored as a function of time (details of experimental procedure given above). It can be observed from FIG. 2 that when a borate/BVSM combination is used, the rate of crosslinking is increased. Additionally, as observed with sample 2-C, the level of crosslinking is additionally increased. Thus, the use of borate compounds in combination with a vinyl-sulfone compound will increase the rate of crosslinking and the amount of crosslinking.

Example 3

This example illustrates the effect of a borate compound combined with 1,2-bis(vinyl-sulfonyl)methane ether (BVSME).

Three samples were prepared using the procedure of Example 1, except that BVSME was used instead of BVSM. A summary of these samples is given in Table 3.

TABLE 3

| Sample Identification | Borate Addition |
|---|---|
| 3-A | Control-None |
| 3-B | 3 wt. % borate* |
| 3-C | 4 wt. % borate* |

*Borate = sodium borate decahydrate, amounts given with respect to gelatin

Figure 3:
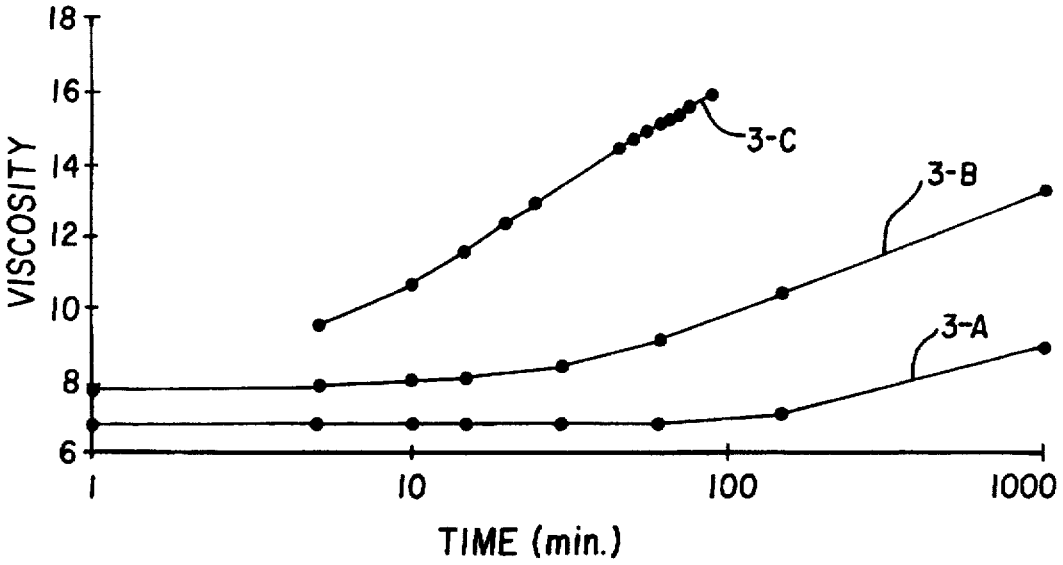
FIG. 3 is a graph showing the increase in rate of hardening a gelatin melt using a combination of a vinyl-sulfone hardener (BVSME) and a borate compound.

Measurements of viscosity were collected as described above. The results are shown in FIG. 3.

Example 4

This example illustrates the effect of combining borate with 1,2-bis(vinyl-sulfonyl acetoamide)ethane (BVSAE).

Samples as set forth in Table 4, were prepared using the procedure of Example 1, except that BVSAE was used instead of BVSM. A summary of these samples is given in Table 4.

TABLE 4

| Sample Identification | Borate Addition |
|---|---|
| 4-A | Control-None |
| 4-B | 3 wt. % borate* |

*Borate = sodium borate decahydrate, amounts given with respect to gelatin

Figure 4:
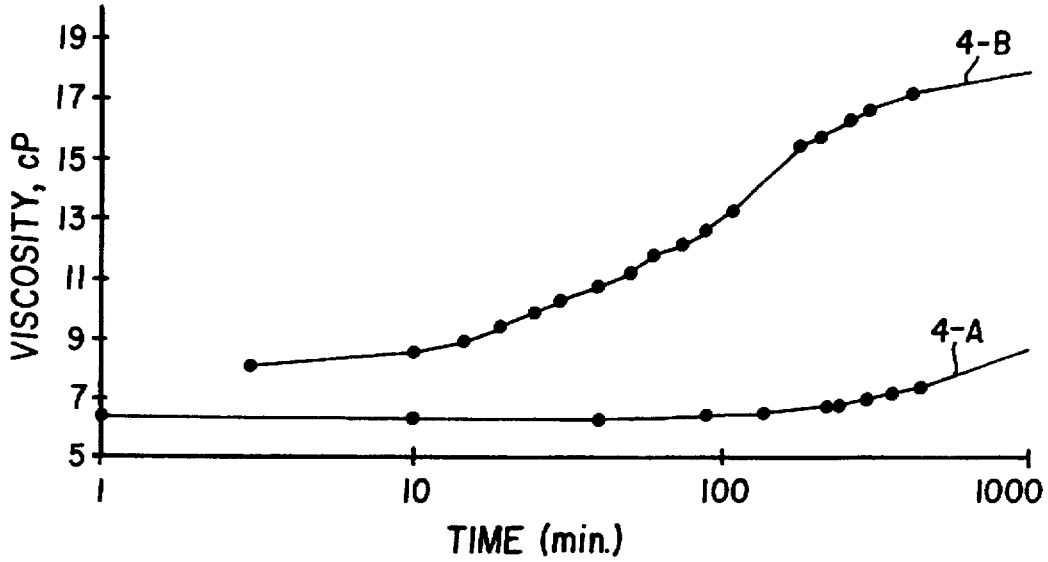
FIG. 4 is a graph showing the increase in rate of hardening a gelatin melt using a combination of a vinyl-sulfone hardener (BVSAE) and a borate compound.

Measurements of viscosity were collected as described above. The results are shown in FIG. 4.

Example 5

This example illustrates the present invention using different types of gelatin.

Samples were prepared using the procedure of Example 1. Two gelatin types were examined: lime processed ossein gelatin (LPO) and acid processed ossein gelatin (APO). A summary of the samples prepared is given in Table 5.

TABLE 5

| Sample Identification | Gelatin Type | Borate Addition |
|---|---|---|
| 5-A | LPO Gelatin | None |
| 5-B | LPO gelatin | 3 wt. % borate |
| 5-C | APO gelatin | none |
| 5-D | APO gelatin | 3 wt. % borate |

*Borate = sodium borate decahydrate, amounts given with respect to gelatin

Figure 5:
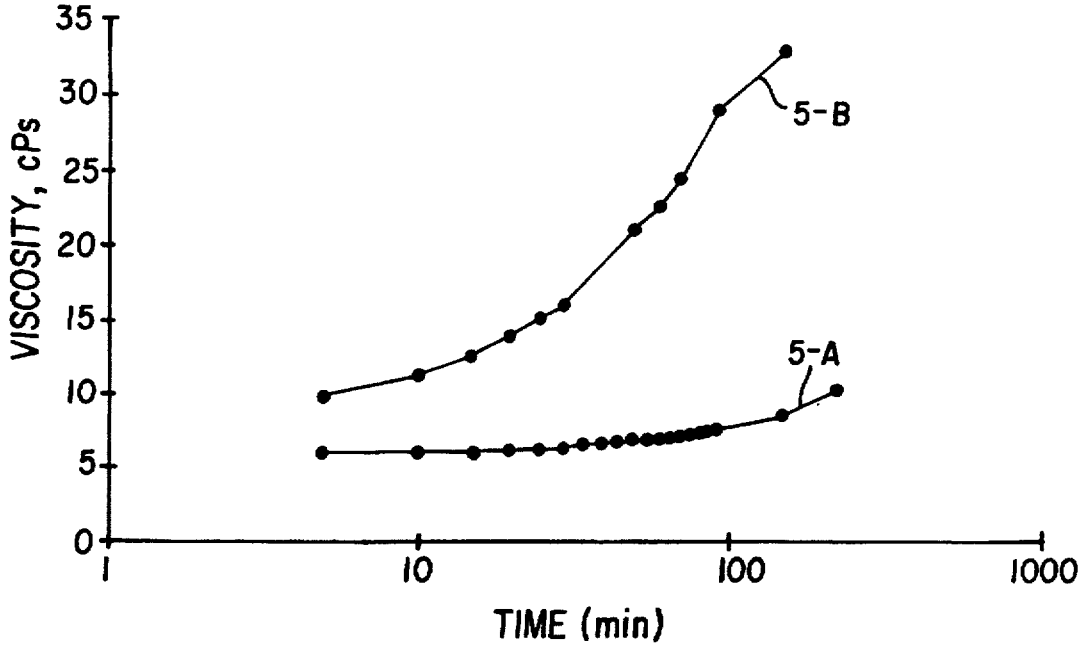
FIG. 5 is a graph showing the increase in rate of hardening a gelatin melt comprising lime processed gelatin using a combination of a vinyl-sulfone hardener (BVSM) and a borate compound.
Figure 6:
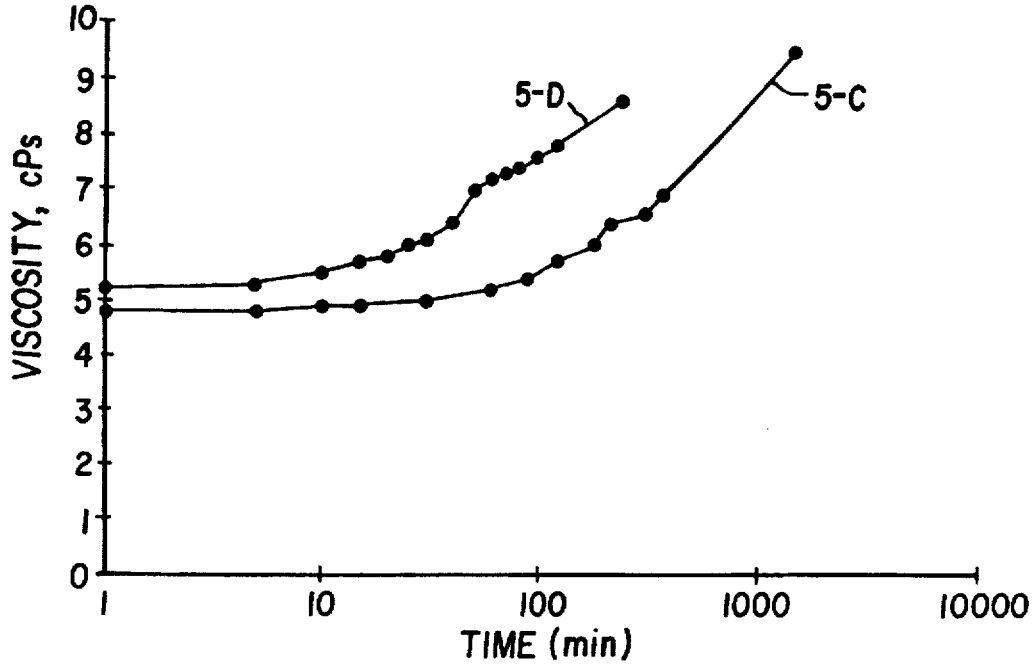
FIG. 6 is a graph showing the increase in rate of hardening a gelatin melt comprising acid processed gelatin using a combination of a vinyl-sulfone hardener (BVSM) and a borate compound.

Viscosity measurements were carried out as described above, and the results are shown in FIGS. 5 and 6.

Example 6

This example illustrates that use of a borate salt having a different anion as the source for borate ions provides the same improvement in hardening.

Two solutions were prepared following the procedure of Example 1 containing 5 wt. % gelatin and 0.098 mmoles of borate. Two sources of borate were used: sodium borate decahydrate and potassium borate tetrahydrate. To each solution BVSM was added (2 wt. % BVSM with respect to gelatin). A summary of these samples is given in Table 6.

TABLE 6

| Sample Identification | Borate Addition | Borate Molar Amount |
|---|---|---|
| 6-A | 3 wt. %* sodium borate | 0.098 mmoles |
| 6-B | 2.4 wt. %* potassium borate | 0.098 mmoles |

*Values taken as a weight percent with respect to gelatin

Figure 7:
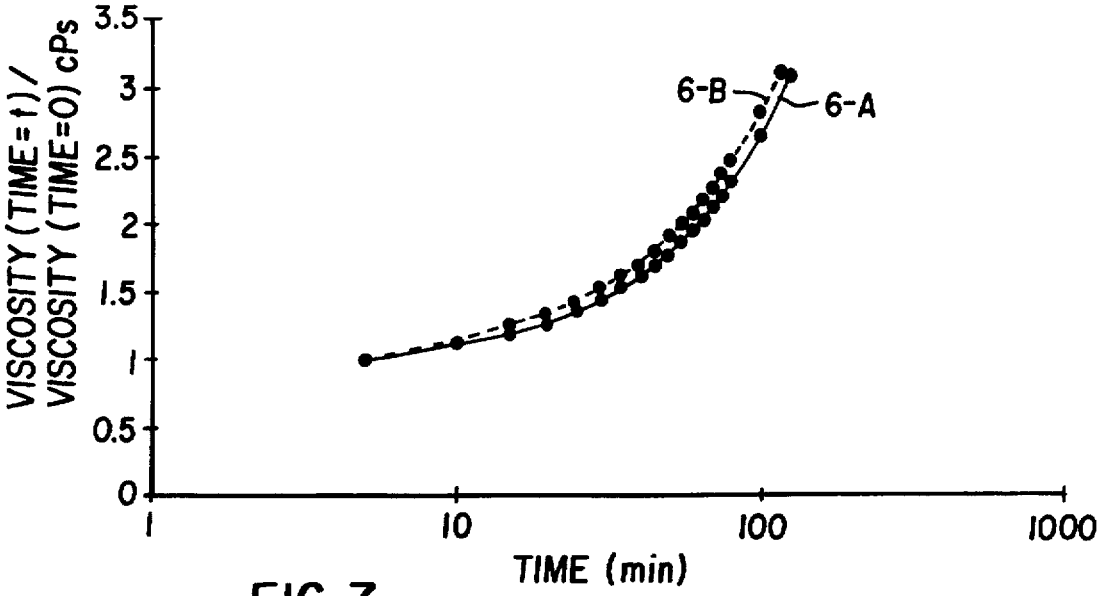
FIG. 7 graph showing the results of hardening gelatin with BVSM using potassium borate versus sodium borate.

The viscosity during chemical hardening was measured as described above. Results are presented in FIG. 7. From these results it was observed that the type of cation used did not influence the measured viscosity behavior.

Example 7

This example illustrates the influence of using a combined borate/vinyl-sulfone hardener on the physical properties of a photographic element.

A photographic element was prepared with 4 layers including a gelatin overcoat containing the vinyl-sulfone hardener (BVSM), a layer containing a fast yellow dispersion with a total of 300 mg/sq. ft. (3230 mg/m$^2$) gelatin, a layer containing a fast magenta dispersion with 300 mg/sq. ft. (3230 mg/m$^2$) gelatin, and a layer containing a fast cyan dispersion with 300 mg/sq. ft. (3230 mg/m$^2$) gelatin. Sodium borate decahydrate was added to layer 3 containing the fast magenta dispersion in the amounts shown in Table 6. A reactive polymer of the formula:

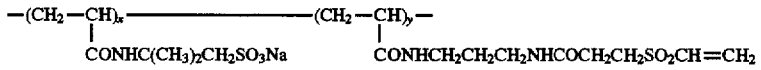

where x/y=4/1;
was added to layer 4 containing the fast cyan dispersion in the amounts shown in Table 7.

| Coating format: |
|---|
| Layer 1: |
| Overcoat-85 mg/ft$^2$ (915 mg/m$^2$) gelatin, 1% surfactant (10 G); 0.75 or 1.5 wt. % BVSM (relative to gel) |
| Layer 2: |
| Fast Yellow Dispersion, 300 mg/ft$^2$ (3230 mg/m$^2$) gelatin; |
| Layer 3: |
| Fast Magenta Dispersion, 300 mg/ft$^2$ (3230 mg/m$^2$) gelatin; sodium borate-decahydrate (amount specified in Table 7) |
| Layer 4: |
| Fast Cyan Dispersion, 300 mg/ft$^2$ (3230 mg/m$^2$) gelatin; reactive polymer-amount specified in Table 7) |
| Support |

TABLE 7

| Sample Identification | Hardener level % | $Na_2B_4O_7$ % | Polymeric Hardener % |
|---|---|---|---|
| 7-01 | 0.75 | 0 | 60 |
| 7-02 | 0.75 | 0 | 30 |
| 7-03 | 0.75 | 0 | 0 |
| 7-04 | 0.75 | 10 | 0 |
| 7-05 | 0.75 | 20 | 0 |
| 7-06 | 0.75 | 10 | 60 |
| 7-07 | 0.75 | 20 | 60 |
| 7-08 | 1.5 | 0 | 60 |
| 7-09 | 1.5 | 0 | 30 |
| 7-10 | 1.5 | 0 | 0 |
| 7-11 | 1.5 | 10 | 0 |
| 7-12 | 1.5 | 20 | 0 |
| 7-13 | 1.5 | 10 | 60 |
| 7-14 | 1.5 | 20 | 60 |

Figure 8:
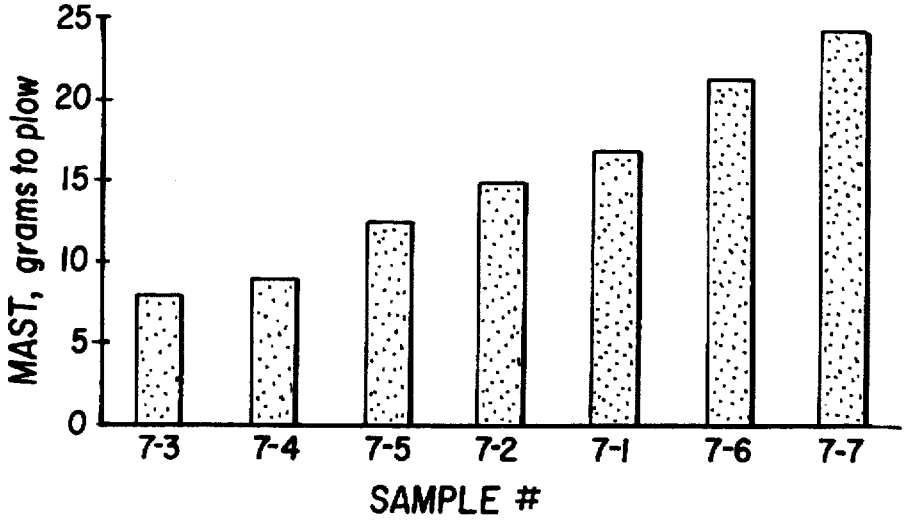
FIG. 8 is a bar chart showing the results of MAST tests (described below) when gelatin is hardened with BVSM (0.75 wt %), a borate and a polymeric hardener.
Figure 9:
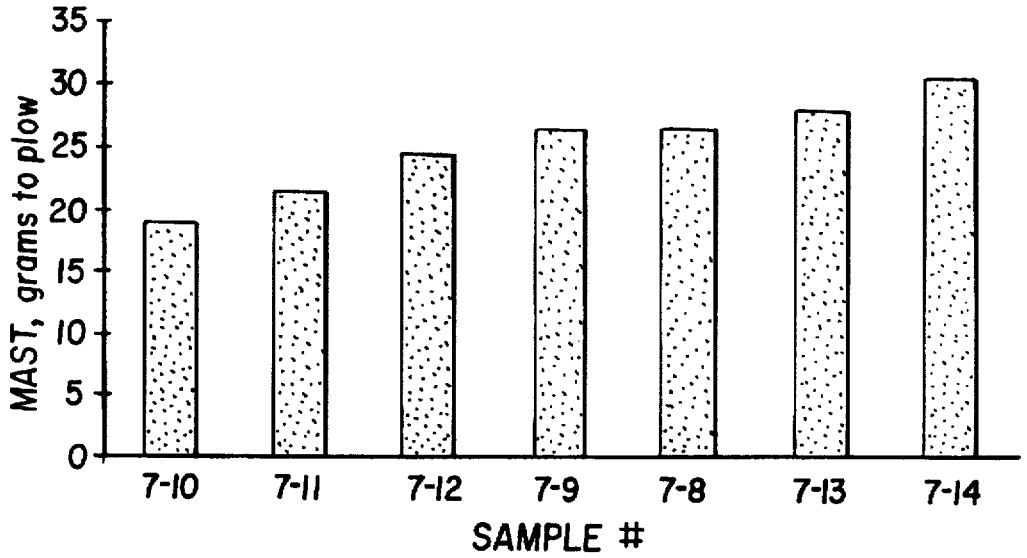
FIG. 9 is a bar chart showing the results of MAST tests (described below) when gelatin is hardened with BVSM (1.5 wt %), a borate and a polymeric hardener.

The resulting coatings were tested using a MAST test where a stylus was dragged across the coating with a linearly increasing load. The point where a visible scratch is observed is taken as the MAST value in units of "grams to plow." The reported value is an average of value when using an 8 mil and a 15 mil diameter stylus. The results are presented in FIGS. 8 and 9.

Figure 10:
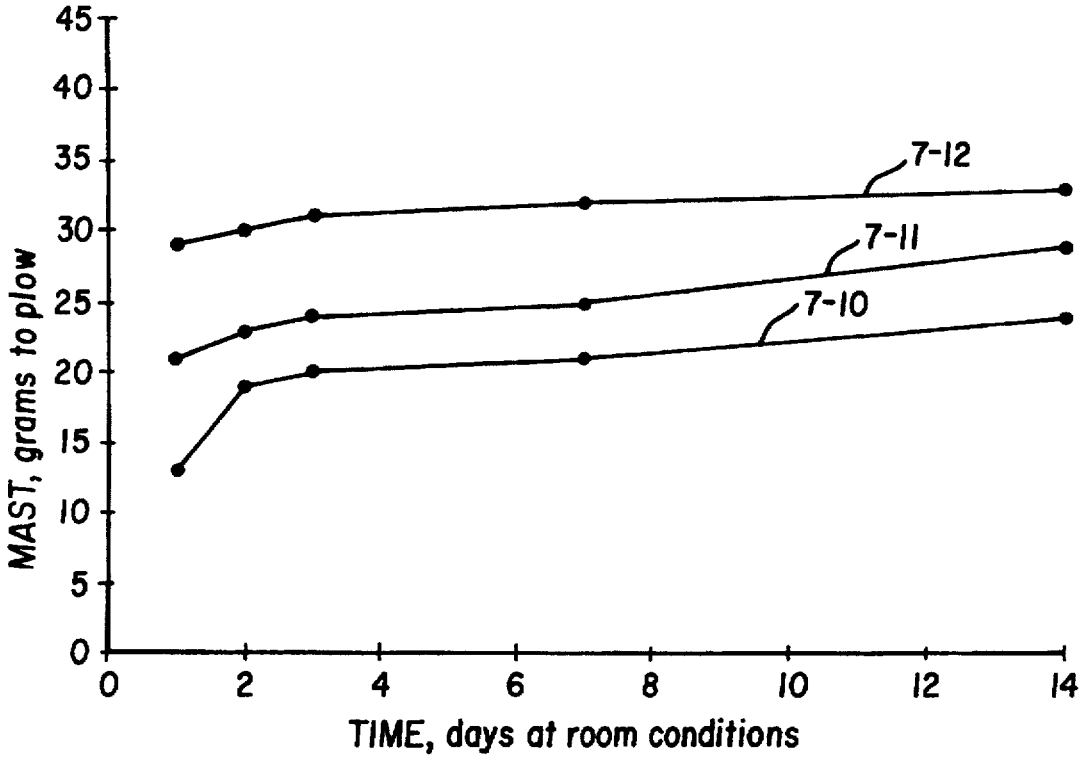
FIG. 10 is a graph showing the results of MAST tests as a function of time for coatings containing sodium borate decahydrate.
Figure 11:
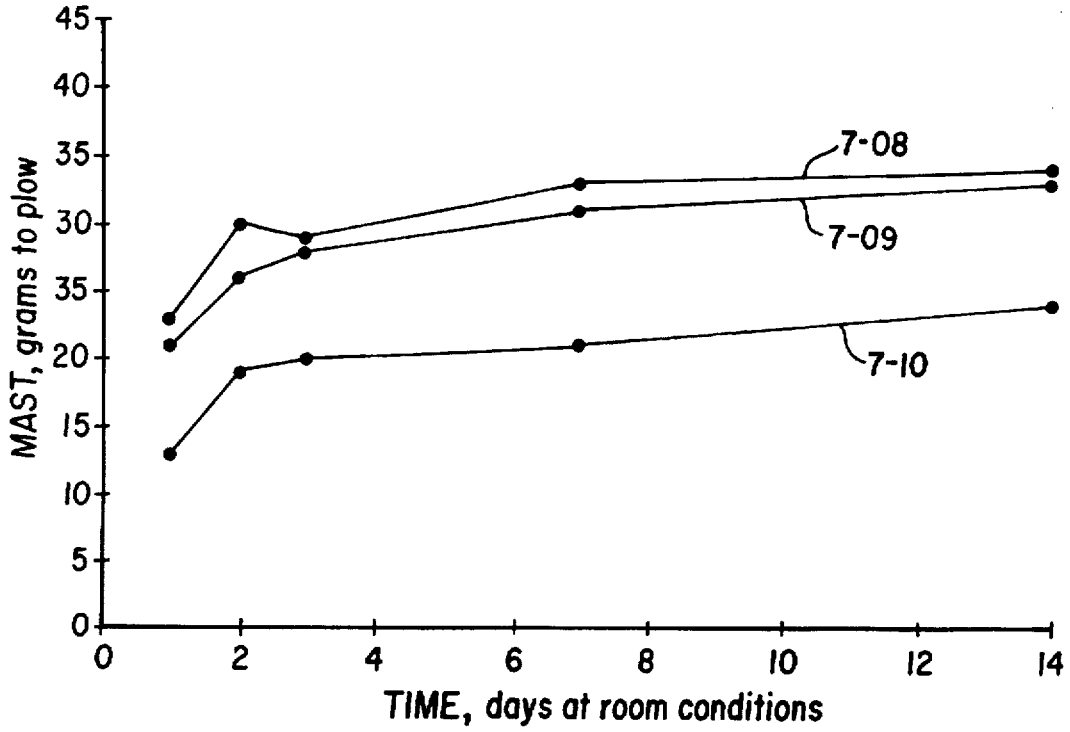
FIG. 11 is a graph showing MAST measurements as a function of time for coatings containing a polymeric hardener.
Figure 12:
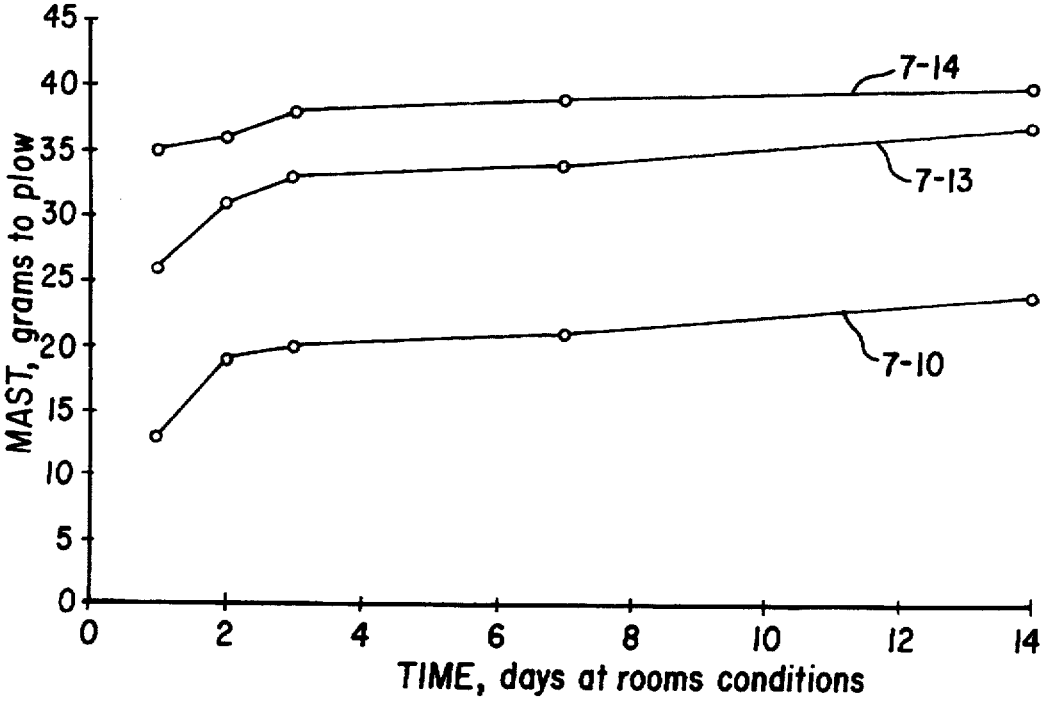
FIG. 12 is a graph showing MAST measurements as a function of time for coatings containing both sodium borate and polymeric hardener.

Samples that were not incubated at elevated temperatures and humidities will continue to chemically hardening for a number of weeks following the coating process, this process is termed afterhardening. During this process, MAST values will tend to increase due to afterhardening. As stated previously, it is desirable to minimize afterhardening. The effect of using borate/hardener combinations on afterhardening was determined by measuring the MAST as a function of time following coating. This type of examination was carried out on samples prepared as in Table 7. The results of these samples are presented in FIGS. 10–12. From FIG. 10, it can be observed that when borate is present, higher initial MAST value are observed with minimal change over time. Thus, afterhardening has been dramatically reduced. This effect is not as pronounced when using polymeric hardeners alone, as observed in FIG. 11. When a borate compound and polymer hardener is combined with BVSM in the same package, afterhardening has been reduced (see FIG. 12). For comparison, the results of FIGS. 8 and 9 have been included on plots in FIGS. 10–12.

Example 8

This example illustrates influence of gelatin and borate concentration were examined by monitoring the concentration required for gelation.

Figure 13:
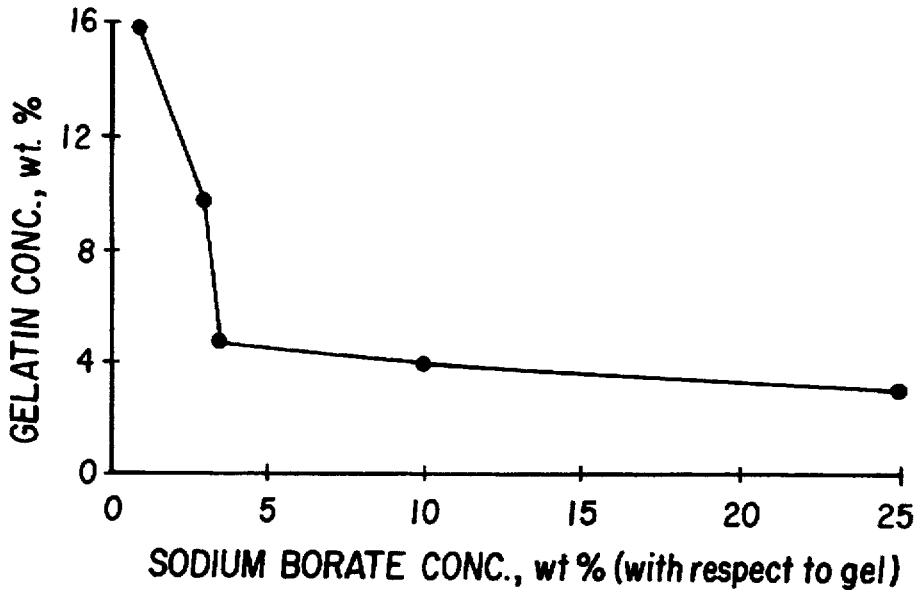
FIG. 13 shows the effect of borate concentration on hardening gelatin with a vinyl-sulfone hardener (BVSM).

The point of gelation is defined by a transition from a liquid to a solid within 1 minute. Solutions or melts were prepared by combining gelatin, water, sodium borate decahydrate, and BVSM (2 wt. % with respect to gelatin). The range of gelatin concentration examined was 2–16 wt. %. The range of sodium borate examined was from 0–25 wt. %. The concentrations required to obtain gelation within 1 minute are presented in FIG. 13. It can be observed that over a wide range of gelatin concentrations, there is a borate concentration that can be added that will facilitate gelation to occur within 1 minute. This sudden gelation is not obtainable at any of the measured gelatin concentrations measured without the borate compound present.

Example 9

This example illustrates the effect of combining BVSM with phenyl boronic acid.

Three solutions were prepared following the procedure of Example 1 with 5 wt. % gelatin, 2 wt. % 1,2-bis(vinylsulfonyl)methane (BVSM) with respect to gelatin. To each of these solutions was added 1 wt. % phenyl boronic acid. A summary of these samples is given in Table 9.

TABLE 9

| Sample Identification | Borate Addition |
|---|---|
| 9-A | Control-No additions |
| 9-B | 1 wt. % phenyl boronic acid (pH = 5.4) |
| 9-C | 1 wt. % phenyl boronic acid (pH = 8.3)* |

*Solution pH was adjusted using sodium hydroxide.

Figure 14:
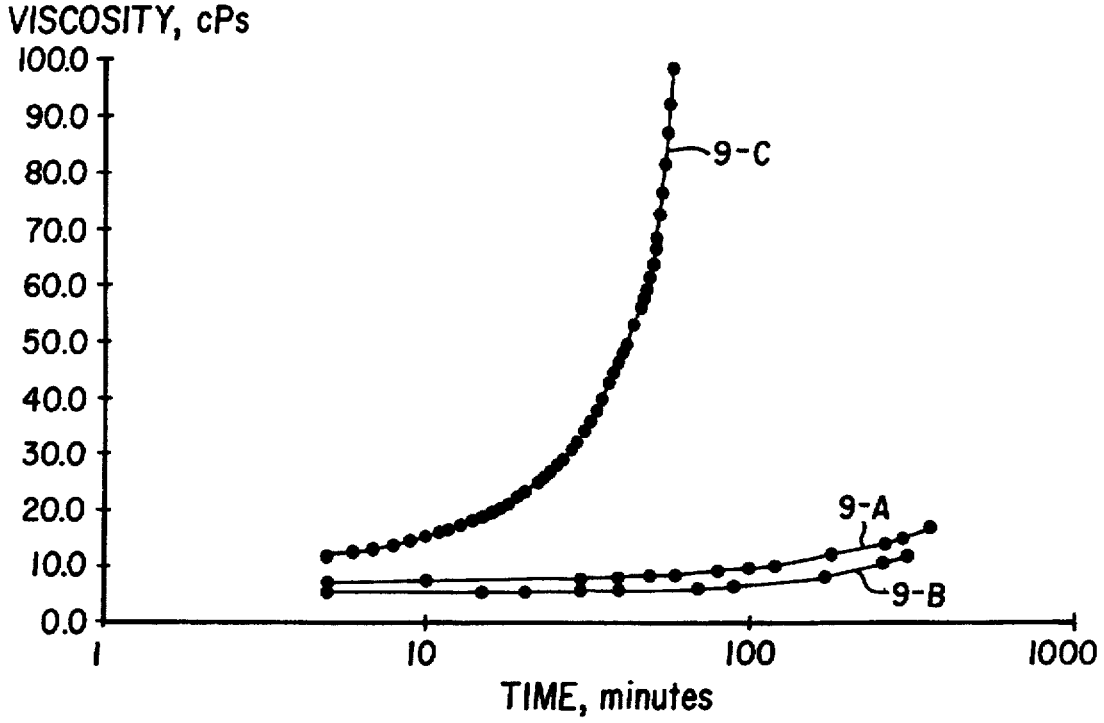
FIG. 14 is a graph showing the increase in rate of hardening a gelatin melt using a combination of a vinyl-sulfone hardener (BVSM) and a phenyl boronic acid.

Measurements of viscosity were collected as described previously, and the results are illustrated in FIG. 14.

The invention has been described in detail with particular reference to preferred embodiments, but it will be understood that variations and modifications can be effected within the spirit and scope of the invention.

What is claimed is:

1. A composition comprising gelatin, a vinyl-sulfone hardener and a borate compound in an amount to accelerate the rate of hardening.

2. A composition according to claim 1, wherein the vinyl-sulfone hardener is a non-polymeric vinyl-sulfone hardener.

3. A composition according to claim 2, wherein the vinyl-sulfone hardener is of Formula (II):

$$X^1—SO_2—L^1—SO_2—X^2 \quad \text{(II)}$$

wherein each of $X^1$ and $X^2$ independently represent —CH=CH$_2$ or —CH$_2$CH$_2$—Y groups, where Y represents a group which can be substituted by a nucleophilic reagent having a nucleophilic group, or a group which can be eliminated in the form of HY by means of a base; and $L^1$ is a divalent linking group which may be substituted.

4. A composition according to claim 3, wherein the vinyl-sulfone hardener is bis(vinyl-sulfonyl) methane, bis (vinyl-sulfonyl methyl) ether or 1,2-bis(vinyl-sulfonyl acetoamide)ethane.

5. A composition according to claim 1, wherein the vinyl-sulfone hardener is a polymeric vinyl-sulfone hardener.

6. A composition according to claim 5, wherein the polymeric vinyl-sulfone hardener is of Formula (III):

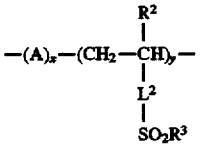

(III)

wherein A is a monomer unit prepared by copolymerizing copolymerizable ethylenically unsaturated monomers, $R^2$ is hydrogen or a lower alkyl group having 1 to 6 carbon atoms; $L^2$ is a bivalent linking group, and $R^3$ is —CH=$CH_2$ or —$CHCH_2CH_2X^3$, where $X^3$ is a group capable of being substituted with a nucleophilic group or a group capable of being released in the form of HX upon addition of a base, and x and y each represents molar percent, x being between 0 and 99 and y being between 1 and 100.

7. A composition according to claim 6, wherein the polymeric vinyl-sulfone hardener is of the formula:

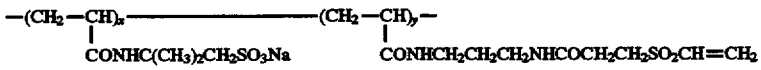

where x/y=4/1.

8. A composition according to claim 1, wherein the vinyl-sulfone hardener is present in an amount of about 0.01 to about 50% by weight, based on the weight of the gelatin.

9. A composition according to claim 1, wherein the vinyl-sulfone hardener comprises a non-polymeric vinyl-sulfone hardener and a polymeric vinyl-sulfone hardener.

10. A composition according to claim 1, wherein the borate compound is a compound of Formula (I), or a salt, hydrate or precursor thereof:

$$B(L)_n \qquad (I)$$

wherein each L is independently —OH, —OR, —NH, —NR, or a substituted or unsubstituted alkyl group, substituted or unsubstituted aryl group, or substituted or unsubstituted heterocyclic group; R is a substituted or unsubstituted alkyl group or substituted or unsubstituted aryl group; and, n is 1, 2, or 3, with the proviso that at least one L is —OH.

11. A composition according to claim 10, wherein the borate compound is sodium or potassium borate, or hydrate thereof, or phenyl boronic acid, or hydrate thereof.

12. A composition according to claim 1, wherein the borate compound is present in an amount of about 14 mmoles to 120 mmoles/100 g gelatin.

13. A method for preparing a photographic element which comprises forming a composition comprising an aqueous medium containing gelatin, a vinyl-sulfone hardener and a borate compound in an amount sufficient to accelerate the rate of hardening, coating the resulting composition into a photographic support and drying.

14. A method according to claim 13, wherein the vinyl-sulfone hardener is a non-polymeric vinyl-sulfone hardener.

15. A method according to claim 14, wherein the vinyl-sulfone hardener is of Formula (II):

$$X^1—SO_2—L^1—SO_2—X^2 \qquad (II)$$

wherein each of $X^1$ and $X^2$ independently represent —CH=$CH_2$ or —$CH_2CH_2$—Y groups, where Y represents a group which can be substituted by a nucleophilic reagent having a nucleophilic group, or a group which can be eliminated in the form of HY by means of a base; and $L^1$ is a divalent linking group which may be substituted.

16. A method according to claim 15, wherein the vinyl-sulfone hardener is bis(vinyl-sulfonyl) methane, bis(vinyl-sulfonyl methyl) ether or 1,2-bis(vinyl-sulfonyl acetoamide) ethane.

17. A method according to claim 13, wherein the vinyl-sulfone hardener is a polymeric vinyl-sulfone hardener.

18. A method according to claim 17, wherein the polymeric vinyl-sulfone hardener is of Formula (III):

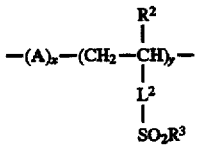

(III)

wherein A is a monomer unit prepared by copolymerizing copolymerizable ethylenically unsaturated monomers, $R^2$ is hydrogen or a lower alkyl group having 1 to 6 carbon atoms; $L^2$ is a bivalent linking group, and $R^3$ is —CH=$CH_2$ or —$CHCH_2CH_2X^3$, where $X^3$ is a group capable of being substituted with a nucleophilic group or a group capable of being released in the form of HX upon addition of a base, and x and y each represents molar percent, x being between 0 and 99 and y being between 1 and 100.

19. A method according to claim 18, wherein the polymeric vinyl-sulfone hardener is of the formula:

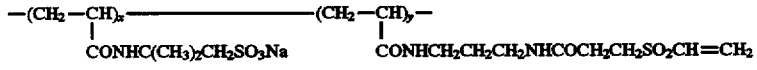

where x/y=4/1.

20. A method according to claim 13, wherein the vinyl-sulfone hardener is present in an amount of about 0.01 to about 50% by weight, based on the weight of the gelatin.

21. A method according to claim 13, wherein the vinyl-sulfone hardener comprises a non-polymeric vinyl-sulfone hardener and a polymeric vinyl-sulfone hardener.

22. A method according to claim 13, wherein the borate compound is of Formula (I), or a salt, hydrate or precursor thereof:

$$B(L)_n \quad \text{(I)}$$

wherein each L is independently —OH, —OR, —NH, —NR, or a substituted or unsubstituted alkyl group, substituted or unsubstituted aryl group, or substituted or unsubstituted heterocyclic group; R is a substituted or unsubstituted alkyl group or substituted or unsubstituted aryl group; and, n is 1, 2, or 3, with the proviso that at least one L is —OH.

23. A method according to claim 22, wherein the borate compound is sodium or potassium borate, or hydrate thereof, or phenyl boronic acid, or hydrate thereof.

24. A method according to claim 13, wherein the borate compound is present in an amount about 14 mmoles to 120 mmoles/100 g gelatin.

25. A photographic element prepared in accordance with claim 13.

* * * * *